US010584696B2

(12) United States Patent
Reid et al.

(10) Patent No.: US 10,584,696 B2
(45) Date of Patent: Mar. 10, 2020

(54) SUBSEA MULTIPISTON PUMP MODULE AND SUBSEA MULTISTAGE PUMP

(71) Applicant: FUGRO-IMPROV PTY LTD, Canning Vale (AU)

(72) Inventors: Brendan Reid, Maylands (AU); Keith Dicker, Kallaroo (AU); Ben Ash, Leeming (AU)

(73) Assignee: FUGRO-IMPROV PTY LTD (NL)

( * ) Notice: Subject to any disclaimer, the term of this patent is extended or adjusted under 35 U.S.C. 154(b) by 290 days.

(21) Appl. No.: 15/573,425

(22) PCT Filed: May 6, 2016

(86) PCT No.: PCT/NL2016/050328

§ 371 (c)(1),
(2) Date: Nov. 10, 2017

(87) PCT Pub. No.: WO2016/182346

PCT Pub. Date: Nov. 17, 2016

(65) Prior Publication Data

US 2018/0112655 A1 Apr. 26, 2018

Related U.S. Application Data

(60) Provisional application No. 62/187,292, filed on Jul. 1, 2015.

(30) Foreign Application Priority Data

May 12, 2015 (NL) ..... 2014795

(51) Int. Cl.
*F04B 49/00* (2006.01)
*E21B 33/064* (2006.01)
(Continued)

(52) U.S. Cl.
CPC ..... *F04B 49/007* (2013.01); *E21B 33/0355* (2013.01); *E21B 33/061* (2013.01);
(Continued)

(58) Field of Classification Search
CPC ..... F04B 49/007; F04B 49/06; F04B 49/22; F04B 9/111; F04B 9/113; F04B 9/117;
(Continued)

(56) References Cited

U.S. PATENT DOCUMENTS 4,003,679 A * 1/1977 McManigill ..... F04B 9/06 417/246
4,096,059 A * 6/1978 Pinkerton ..... A61M 1/1656 137/99

(Continued)

OTHER PUBLICATIONS

International Search Report and Written Opinion; PCT Application No. PCT/NL2016/050328; dated Oct. 10, 2016.

*Primary Examiner* — Charles G Freay
*Assistant Examiner* — Thomas Fink
(74) *Attorney, Agent, or Firm* — Polsinelli PC

(57) ABSTRACT

The present invention relates to a subsea multipiston pump module, a subsea multistage pump and skid, having two reciprocating pistons controlled by a control means in such a way that the pistons can be driven either in a parallel mode, where the pistons are driven in phase with each other, or in a serial mode, where the pistons are driven out of phase with each other, wherein the pistons are fluidly connected with each other by a piston connection means in such a way that in parallel mode they are fluidly connected in parallel, and in serial mode, they are fluidly connected in serial. Further, the invention relates to a method of pumping a media fluid under subsea conditions.

24 Claims, 10 Drawing Sheets

(51) Int. Cl.

| | |
|---|---|
| ***E21B 41/00*** | (2006.01) |
| ***E21B 33/035*** | (2006.01) |
| ***F04B 47/04*** | (2006.01) |
| ***F04B 9/111*** | (2006.01) |
| ***E21B 33/06*** | (2006.01) |
| ***F04B 1/02*** | (2006.01) |
| ***F04B 9/113*** | (2006.01) |
| ***F04B 23/06*** | (2006.01) |
| ***F04B 49/06*** | (2006.01) |
| *F04B 49/22* | (2006.01) |

(52) U.S. Cl.
CPC ..... *E21B 33/064* (2013.01); *E21B 41/0007* (2013.01); *F04B 1/02* (2013.01); *F04B 9/111* (2013.01); *F04B 9/113* (2013.01); *F04B 23/06* (2013.01); *F04B 47/04* (2013.01); *F04B 49/06* (2013.01); *F04B 49/22* (2013.01); *F04B 2203/0902* (2013.01)

(58) Field of Classification Search
CPC ..... F04B 9/1172; F04B 47/04; F04B 23/06; F04B 1/02; F04B 2203/0902; E21B 41/007; E21B 33/0355; E21B 33/061; E21B 33/064
USPC ..... 417/62
See application file for complete search history.

(56) References Cited

U.S. PATENT DOCUMENTS

| | | | | |
|---|---|---|---|---|
| 5,431,545 | A * | 7/1995 | Knight | B08B 9/0551 417/248 |
| 5,588,813 | A * | 12/1996 | Berke-Jorgensen | B67D 1/107 417/391 |
| 5,634,773 | A * | 6/1997 | Tanino | F04B 9/1178 417/46 |
| 5,755,561 | A * | 5/1998 | Couillard | F04B 11/0075 417/246 |
| 8,083,501 | B2 * | 12/2011 | Scarsdale | F04D 13/086 417/423.15 |
| 2007/0258831 | A1 * | 11/2007 | Irick | F04B 5/02 417/62 |
| 2009/0044951 | A1 * | 2/2009 | Milkovisch | E21B 49/10 166/369 |
| 2010/0119380 | A1 * | 5/2010 | Wilson | E21B 41/0007 417/53 |
| 2010/0119382 | A1 | 5/2010 | Scarsdale | |
| 2010/0143155 | A1 * | 6/2010 | Preiswerk | F04B 1/02 417/1 |
| 2013/0104631 | A1 * | 5/2013 | Tokuo | F04B 13/00 73/61.56 |
| 2013/0112420 | A1 | 5/2013 | Bisset | |
| 2013/0336803 | A1 * | 12/2013 | Ruegenberg | F04B 49/22 417/12 |
| 2014/0094727 | A1 * | 4/2014 | Deshpande | A61H 9/005 601/152 |
| 2014/0124211 | A1 | 5/2014 | Warnock, Jr. et al. | |
| 2015/0104328 | A1 | 4/2015 | Babbitt et al. | |
| 2019/0010936 | A1 * | 1/2019 | Combrink | F04B 17/03 |
| 2019/0120031 | A1 * | 4/2019 | Gilje | E21B 43/129 |
| 2019/0154017 | A1 * | 5/2019 | Wichmann | F04B 9/1095 |

* cited by examiner

SUBSEA MULTIPISTON PUMP MODULE AND SUBSEA MULTISTAGE PUMP

CROSS-REFERENCE TO RELATED APPLICATIONS

This application is a national stage application of International Application No. PCT/NL2016/050328, which was filed on May 6, 2016, which claims priority to The Netherlands Application No. 2014795, which was filed May 12, 2015, and U.S. Provisional Application No. 62/187,292, which was filed Jul. 1, 2015, each of which is incorporated by reference in their entireties.

The invention relates to a subsea multipiston pump module, especially for closing a hydraulic ram of a blowout preventer (BOP).

The invention also relates to a subsea multistage pump comprising a multiple of the before mentioned subsea multipiston pump modules. The invention also relates to an intervention skid, especially for attachment to a remotely operated vehicle (ROV) and to a method of pumping a fluid from a source to a target under subsea conditions.

In the field of subsea exploration and subsea exploitation, e. g. off shore oil and gas developments or underwater mining, pumps are irreplaceable tools. They are especially used for subsea IRM and drill support operations but also for fluid injection, hydraulic system operations or high pressure water cleaning. Subsea conditions thereby require a high specialization and adaption of the systems used.

Normally, subsea pump systems are driven by hydraulic or electro hydraulic motors wherein a hydraulic pump is used to move a media fluid, for example seawater, between a source and a target. In combination with a blowout preventer (BOP), pumps are used in emergency situations to close the BOP by applying a media fluid under a specific hydraulic pressure to activate the closing process. As legal requirements demand that closing of such a BOP has to be performed within a special time limit, great demands are made on the technical equipment and especially on the pumps. A respective solution for providing a high fluid flow and a sufficiently high fluid pressure for actuating and closing the BOP respectively, provides for using different pumps, each pump adapted either for providing a high fluid flow and a low pressure or a lower fluid flow and a higher fluid pressure. By activating the respective pumps, one after the other, the required flow and pressure conditions are reached.

That means that especially when a BOP has to be closed at first a pump is used providing a high fluid flow under a low fluid pressure, wherein, when a special pressure level is reached, a second piston replaces the first piston adapted to provide a higher pressure level and therefore naturally a lower fluid flow.

The drawback of such an arrangement however is the huge size of the pumping system and its heavy weight. Further, this kind of system has a limited capacity of adaption to user's requirements.

Providing optimal technical equipment for subsea operations is further influenced by the available operating power for providing the required output. This limitation is directly dependent from the electric or hydraulic power sources used under subsea conditions, i. e. provided by ROVs.

It further has been realized in the last years that skids used for a subsea operations almost reached the upper limit of allowable weight and size range and further also the upper limit of hydraulic powers supply available from ROVs. Therefore a high need for light weight and small of size pump equipment exist.

It is therefore an object of the present invention to provide for a reliable and economical pump system which is adaptable without any great efforts to respective requirement, further comprising a reduced size and/or weight.

The before object is solved by a subsea multipiston pump module according to claim 1, a subsea multistage pump according to claim 20, an intervention skid according to claim 22 and a method of pumping a media fluid under subsea conditions according to claim 23.

In detail, the object is solved by a subsea multipiston pump module, especially for closing a hydraulic ram of a blowout preventer, comprising at least a first and a second piston, oscillatingly arranged to pump a media fluid from a source to a target, and being controlled by a control means so that the pistons at least can be driven either in a parallel mode p, where they are oscillating in phase with each other, or in a serial mode s, where they are oscillating out of phase with each other, and especially out of phase by half a cycle, further comprising at least one piston connection means, fluidly connecting the two pistons in a controllable way, so that in parallel mode p the pistons are pumping the media fluid in parallel, resulting in a high media fluid flow and low media fluid pressure, and in serial mode s, they are pumping the media fluid in serial, resulting in a low media fluid flow and a high media fluid pressure.

The object is in detail also solved by a subsea multistage pump comprising at least two multipiston pump modules of the before mentioned and in the following described art, fluidly connected to each other.

The object is in detail also solved by an intervention skid, especially for attachment to a remotely operated vehicle (ROV), the intervention skid comprising at least one multipiston pump module and/or multistage pump as explained herein.

Finally, the object is solved in detail by a method of pumping a media fluid under subsea conditions from a source to a target, the method comprising the steps of pumping the media fluid via a multipiston pump module comprising at least a first and a second piston, oscillatingly arranged to pump a media fluid from a source to a target, and controlling by a control means the first and second pistons in such a way that they are at least either driven in a parallel mode, where they are driven in phase with each other, or in a serial mode, where they are driven out of phase with each other, and especially out of phase by half a cycle, wherein the pistons are connected with each other by at least one piston connection means in a controllable way, so that that in parallel mode p the pistons are pumping the media fluid in parallel, resulting in a high media fluid flow and low media fluid pressure, and in serial mode s, they are pumping the media fluid in serial, resulting in a low media fluid flow and a high media fluid pressure.

It is a key aspect of the present invention that the multipiston pump module comprises at least two preferably reciprocating pistons, which are arranged and provided in such a way, that they can be driven at least in two modes, namely in a mode, where they are oscillating in phase relative to each other, and in another mode, where they are oscillating out of phase especially by half a cycle. As a result, the arrangement of pistons provides for a pump module operating in two different modes, namely a serial operation mode and a parallel operation mode. The module can be used in at least two different configurations, wherein adaption to different requirements is easily possible by the control means and without any revision of the module. Due to use of the at least two pistons operable in different operation modes, the overall size and weight of a subsea pump can be reduced.

The before subsea multipiston pump module can, for example, be used for closing hydraulic rams of a BOP, wherein at the beginning of the closing procedure the pistons are operating in parallel mode and are, thereby, providing within a short time a very high media fluid volume under a relatively low pressure. As soon as the required pressure rises for further closing the BOP, the multipiston pump module operation can be changed to serial mode, where the at least two pistons are operating in a serial configuration, resulting in a reduced fluid flow but a higher media fluid pressure. It is one module providing these at least two operation modes.

It is further a key aspect of the invention that the subsea multipiston pump modules can be arranged to a subsea multistage pump comprising at least two of said multipiston pump modules fluidly connected to each other. Via combining the multipiston pump modules to a multistage pump, specification and adaption of the pump output is possible in an easy and cost effective way. As the respective multipiston pump modules each can further be adapted by driving them in serial mode or in parallel mode, a high flexible multistage pump is provided.

Preferably, the multipiston pump modules are fluidly connected with each in parallel. For connecting the modules with each other, complementary operational connection means and especially connection plates comprising respective fluid manifolds are provided at each pump module. The operational connection means are preferably provided for connecting fluid piping, pressure piping, control means or other control means of the multipiston pump modules with each other.

Preferably the pistons, e. g. at least the first and the second piston, of the module are arranged within a common housing. Also preferably the module comprises a common housing comprising the pistons, the valvings and respective connection means for connecting the module to a further module or to a supply means i.e. a ROV. Such a common housing can be an integrally formed housing, i. e. formed from one piece, it however could also be a housing comprising different parts attached with each other and forming a housing for the at least two pistons and the module respectively. A multipiston pump module having such housing is easily to arrange and especially to combine with other respective multipiston pump modules.

The housing preferably comprises complementary connection means for connecting at least two modules with each other. Such connections means can e.g. be screw or bolt connection means, hook means or similar connection elements. Preferably, the connection means and/or the housing are provided in such a way that the subsea multipiston pump modules can be stacked to each other and preferably can be stacked to each other providing a row, line or matrix arrangement of the different multipiston pump modules in a two or three dimensional way. A stacking of multiple multipiston pump modules is preferably arranged in such a way that it can be lifted and transported in one piece.

Preferably the pistons provided with the module are primarily identical. This reduces transport and storing effort. This preferably also applies for the dimensions of the piston heads, the piston length, the compression rate and/or the dimensions of the piston chambers the pistons are oscillating in. Also this preferably applies for the output of each piston compared to the other piston when operated in parallel mode.

The pistons are preferably having two piston heads each, oscillating forth and back in respective piston chambers under the control of the control means for pumping the media fluid. The pistons can be controlled by the control means, and especially the phase of one piston can be controlled relative to the phase of the other. In parallel mode, the pistons are oscillating in parallel, i.e. when the first piston is oscillating e. g. to the left side, also the second piston is oscillating to the left side, and vice versa. In serial mode, the pistons are oscillating out of phase with each other and especially out of phase by half cycle. That means that when the first piston is oscillated e. g. to the left side, the second piston is oscillated to the opposite side, e.g. the right side, and vice versa.

Preferably, the module operates by driving the pistons back and forth at the rate of a several cycles per second. Each piston is preferably provided as a hydraulic piston, driven by a drive fluid. This drive fluid can for example be provided by a ROV.

The piston heads are preferably forced into the piston chambers alternately sucking media fluids and for example sea water in and then discharging it under pressure. The flow rate of the media fluid is proportional to the speed of the piston which is in turn proportional to the hydraulic flow rate of the drive fluid and further depends on the operation mode of the module.

Preferably the pistons comprise at least two piston heads oscillating forth and back in respective piston chambers under the control of the control means for pumping the media fluid. Each piston is further preferably fluidly connected with a suction manifold for suction of the media fluid and with a discharged manifold for discharge of the media fluid.

Especially in the light of the above the suction manifold of each piston comprises at least one check valve and/or the discharge manifold of each piston comprises at least one check valve.

Preferably each piston head and/or piston chamber of the first and second pistons comprises at least two check valves, at least one for suction of the media fluid through a suction manifold into the pump and at least one for discharge of the media fluid through a discharge manifold out of the pump.

The media fluid is preferably at least a fluid chosen from the group comprising sea water, fresh water, glycol, methanol or other similar fluids or a mixture thereof. The media fluid can preferably be stored in a fluid reservoir wherein this fluid reservoir preferably comprises a bladder reservoir adapted to be filled with sea water, fresh water, glycol or a mixture thereof.

With other words, preferably each piston, i. e. the first piston and the second piston preferably comprises at least two piston head/piston chamber assemblies, each meant to be a pump head. The piston having the two pump heads than is preferably fitted with at least four check valves, at least two for each pump head, to manage media fluid and especially sea water or water coming into and out of the pump heads. Preferably, each pump head has a check valve to admit media fluid into the pump from the suction manifold and another check valve to permit media fluid to enter the discharge manifold.

As mentioned before, preferably the pistons are hydraulic pistons driven by drive fluid, especially supplied from a remotely operated vehicle (ROV). This drive fluid is preferably hydraulic oil or a similar fluid. By providing the operational power from the ROV, size, weight and price of the multipiston pump modules is reduced as no own power supply is required. As the multipiston pump module can be driven with the at least two different operation modes, the (limited) power normally provided from the ROVs is sufficient, so that a reliable subsea operation is possible.

Preferably, the control means is arranged in such a way that it directs the drive fluid to the pistons in a time controlled manner for driving the pistons and especially for controlling the phase of the pistons individually.

Reciprocating pistons need some sort of valving to make them oscillate. Traditionally, these pistons have internal valving that switches the drive fluid manifold, i.e. pressure and tank lines, between each side of the hydraulic piston to oscillate them for operation. According to the invention, preferably the pistons are controlled via control means and preferably via use of electronic means.

The control means are preferably arranged in such a way that they can control the pistons of each multipiston pump module. With a multistage pump preferably each module has its own control means, which are preferably remotely controllable e.g. via a ROV or a remote instance controlling the ROV. For controlling a multistage pump having multiple multipiston pump modules attached and connected to each other also external control means can be used controlling each or some piston(s) of the different modules.

Preferably, the control means is arranged to switch the fluid flow of the driving fluid between at least two hydraulic piston chambers of at least one piston, for changing the oscillation phase of the respective piston.

Further the control means is preferably arranged to switch the fluid flow dependent on the media fluid pressure. I.e. the control means is preferably arranged in such a way that it can detect and/or is provided with information regarding the fluid pressure and especially the output fluid pressure of the media fluid and can react e g. in changing the drive of the pistons from parallel mode to serial mode, or vice versa from serial mode to parallel mode when this is necessary i.e. when a defined pressure threshold is reached.

Preferably, the control means is remotely controllable and especially software controllable.

Preferably, the control means comprises at least one electronically controllable valve to control at least one piston and especially comprises at least one solenoid and/or servo valve provided in a drive fluid manifold of the pistons. This drive fluid manifold preferably provides the drive fluid from an ROV, a fluid reservoir or a similar drive fluid source and reservoir to and from the pistons. The drive fluid manifold preferably connects the pistons in a parallel configuration.

Preferably, the control means comprises sensor means for detecting the media fluid pressure especially during the multipiston pump module operation. These sensor means is preferably arranged on the output side and preferably in the discharge manifold of the pistons and/or the multipiston pump module and/or the multistage pump.

Preferably, the control means is arranged to automatically change the pump mode from parallel mode to serial mode and/or vice versa, when a defined pressure threshold in the media fluid on the output side and especially in the discharge manifold is detected.

As mentioned, the pistons are connected via at least one piston connection means in a controllable manner. Preferably this provides that either an established or a closed cross feed fluid connection is provided between the two pistons. In the parallel mode, the connection is preferably closed, so that no media fluid interchange happens, wherein in the serial mode the connection is preferably established, so that media fluid from the one pump is directed to the other pump.

Preferably here the cross feeding valve means comprises at least one valve wherein the valve further preferably is a check valve.

Preferably, such piston connection means comprises essentially, at least one valve that connects the output of one piston to the inlet of another piston.

Preferably the valve is arranged in such a way that it establishes a fluid connection between the first and the second piston, when they are driven in serial mode s.

Preferably the cross feeding valve means comprises at least one valve arranged within the piston connection means and especially in at least one fluid connection between a piston chamber of the first piston and a piston chamber of the second piston, so that with an establish fluid connection, e.g. an open valve, media fluid can be driven from one chamber of the one piston to another chamber of the other piston. Preferably all piston chambers of the one piston are fluidly connected with the respective other chambers of the other piston, wherein respective valves are provided for opening and closing the connection.

Preferably, the cross feeding valve means is arranged in such a way that in the serial mode an output of the nearside piston head of the first piston is directed to an input of a farside piston head of the second piston, so that the media fluid pressure outputted from the first piston is additive to the drive fluid pressure of the second piston, or vice versa. "Nearside piston head" is the piston head of a piston acting in a compression mode, i.e. the one reducing the volume of its piston chamber thereby discharging the media fluid out of its piston chamber. The "farside piston" is the piston operating in a discharge mode, i.e. the one increasing the volume of its piston chamber thereby sucking in the media fluid.

Preferably, the cross feeding valve means is remotely and preferably electronically controllable.

The subsea multipiston pump module is preferably designed for subsea IRM and drill support operations, but could be used also for fluid injection, hydraulic system operation or high pressure water cleaning without modification.

Further specifications of the module and the multistage pump are possible. Some are: In high pressure mode preferably four multipiston pump modules are connected in parallel to provide a multistage pump. They preferably provide a performance of 189 lpm and 485 bar+/−10%, more preferably +/−5% in high pressure mode, and 178 lpm and 180 bar+/−10%, more preferably +/−5% in low pressure mode. Preferably, the multipiston pump module comprises or is connectable to a remote control system adapted for electronic control of the multipiston pump module, monitoring of output performance and/or internal diagnostics. Preferably, an onboard pump performance monitor (OPPM) is provided for monitoring discharge flow and pressure and allows for operational testing down to the individual piston level. Preferably, the multipiston pump module comprises a manifold base by which the multipiston pump modules can be arranged and connected to each other in different configurations. Further, by use of such a manifold base, change out of multipiston pump modules can be performed very quickly. By use of electronic control, multipiston pump modules and especially failed modules can preferably be identified and/or isolated from the system remotely to continue operation at a possible reduced or maintained performance.

As mentioned before, the present invention, beside a subsea multipiston pump module, also relates to a subsea multistage pump, an intervention skid, especially for attachment to a remotely operated vehicle (ROV), and to a method of pumping a media fluid under subsea conditions. For this arrangements, skids and methods the embodiments, variations and modifications of the multipiston pump module as mentioned herein are applicable without any modification. Therefore, a detailed explanation is omitted for redundancy reasons. All of the before and herein mentioned with regard to the subsea multipiston pump module can be applied to the inventive subsea multistage pump, the intervention skid and the method and vice versa.

Other modifications of the invention may arise from the sub claims.

Other features and advantages of the invention will be more fully understood from the detailed description of embodiments of the invention, taken together with the accompanying drawings, which are meant to illustrate and not to limit the invention.

In the drawings:

FIG. 1 schematically shows a perspective view of one embodiment of a subsea multipiston pump module;

In the following, for identical parts the same reference signs are used, wherein high indices might be set.

FIG. 1 to 3 are showing different views of a first embodiment of a subsea module 1 of the present invention, wherein a general pump schematic of said embodiment is shown with FIG. 4 in details.

Figure 1:
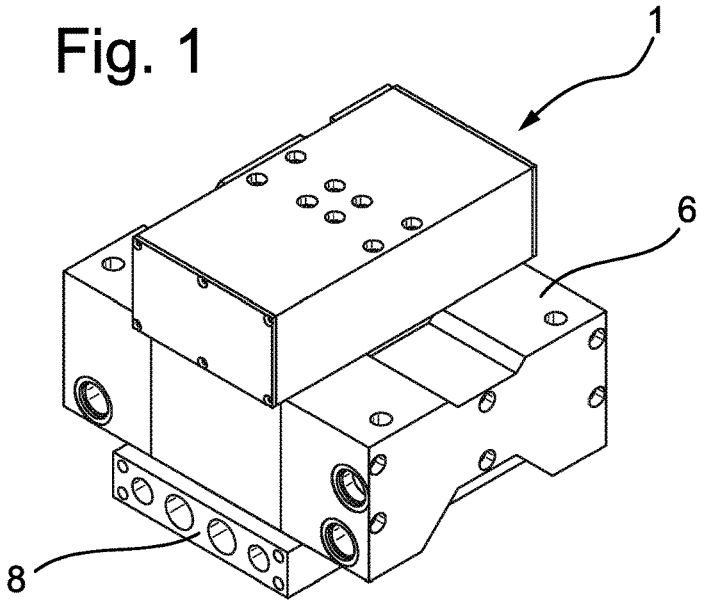

The subsea multipiston pump module 1 is especially prepared for closing a hydraulic ram of a blowout preventer (BOP) under subsea conditions. It is preferably built for being attached to a skid and being driven by a remotely operated vehicle (ROV).

The subsea module 1 comprises a first reciprocating piston 10 and a second reciprocating piston 20, being configured to pump a media fluid 2 from a source to a target under subsea conditions, e.g. from a fluid tank or directly from sea to a BOP.

The pistons 10, 20 are controlled by a control means 4 in such a way that they at least can be driven either in a parallel mode (p) where they are oscillating in phase with each other or in a serial mode (s) where they are oscillating out of phase with each other, and especially out of phase by half a cycle.

The multipiston pump module 1 further comprises at least one piston connection means 31, fluidly connecting the two pistons in a controllable manner, so that in parallel mode p the pistons 10, 20 are pumping the media fluid in parallel, resulting in a high media fluid flow and low media fluid pressure, and in serial mode s, they are pumping the media fluid in serial, resulting in a low media fluid flow and a high media fluid pressure.

One important aspect of the present invention is that, by means of the cross feeding valves it is preferably provided a controllable way for pistons to work in parallel mode, wherein both pistons have, at least, a common outlet (i.e., their outlets are connected amongst them) and, preferably, they also have a common inlet (i.e. their inlets are connected amongst them). On the other hand, in serial mode, the cross feeding valves modify this arrangement to provide that the outlet of at least one of the pistons is connected to the inlet of at least another piston thereby providing a serial connection between them. Preferably, their inlets can be connected to a common fluid source for both modes of operation.

The exact pump schematic will be explained in the following with regard to FIG. 4 and in more detail with regard to FIGS. 5 to 8.

Figure 2:
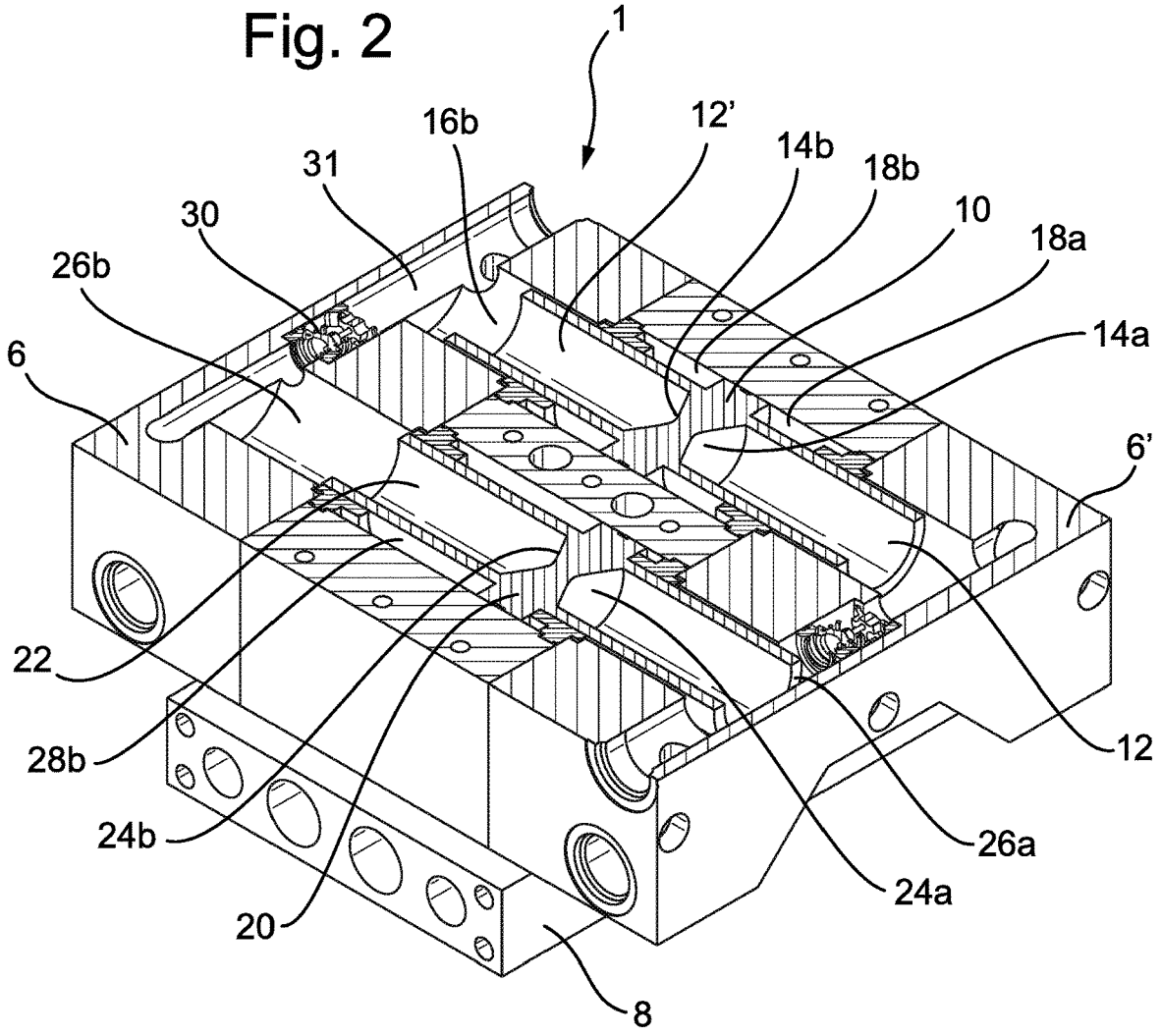
FIG. 2 shows a cross section of the multipiston pump module according to FIG. 1.
Figure 3:
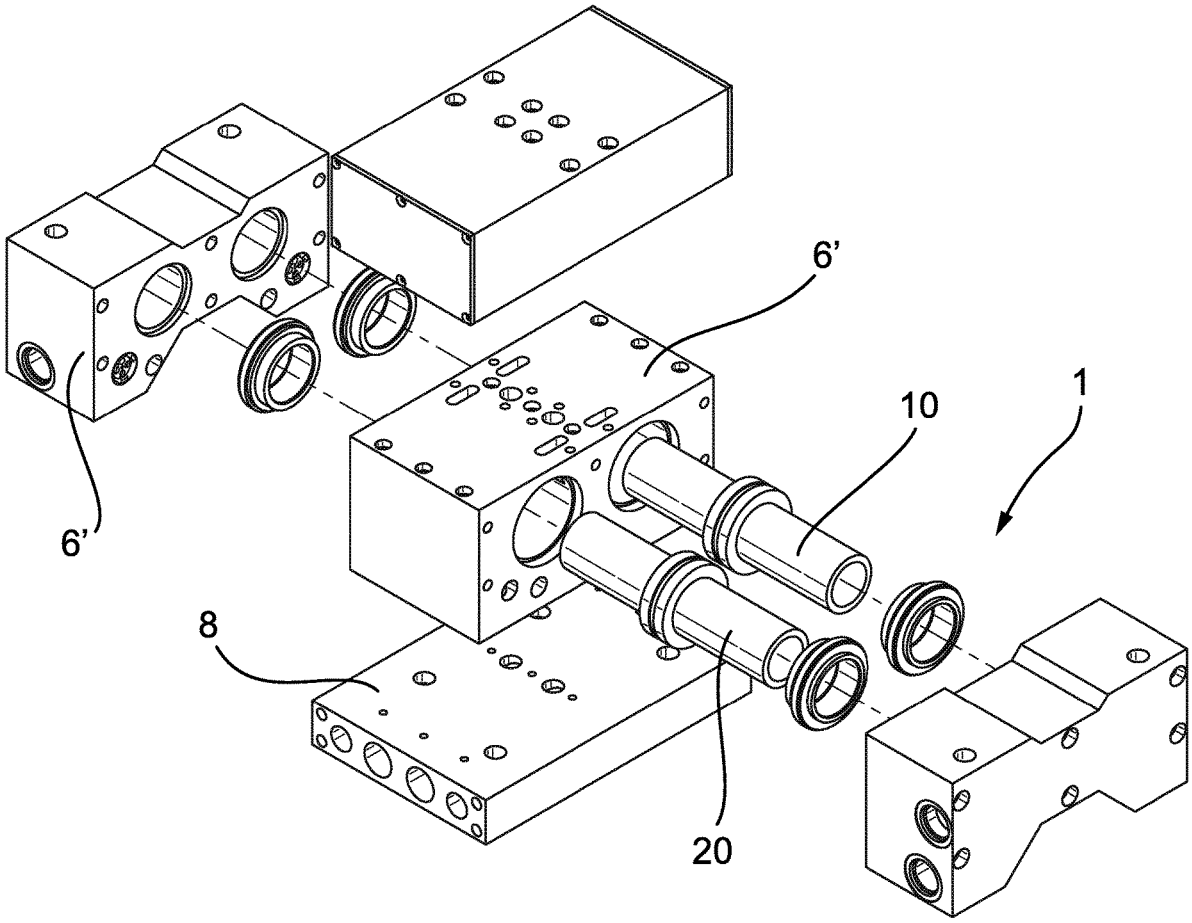
FIG. 3 shows an exploded view of the multipiston pump module according to FIG. 1.

As can be seen in FIG. 1 to 3, the pistons 10, 20 are arranged within a common housing 6 provided preferably by several parts attached to each other. At least one of the multipiston pump modules 1 comprises a manifold plate 8 for connection with another subsea multipiston pump module 1 of the same or another category (also see FIGS. 9 and 10). By connecting multiple multipiston pump modules 1 a multistage pump 100 can be provided as will be explained in the following with FIGS. 9-11.

Figure 4:
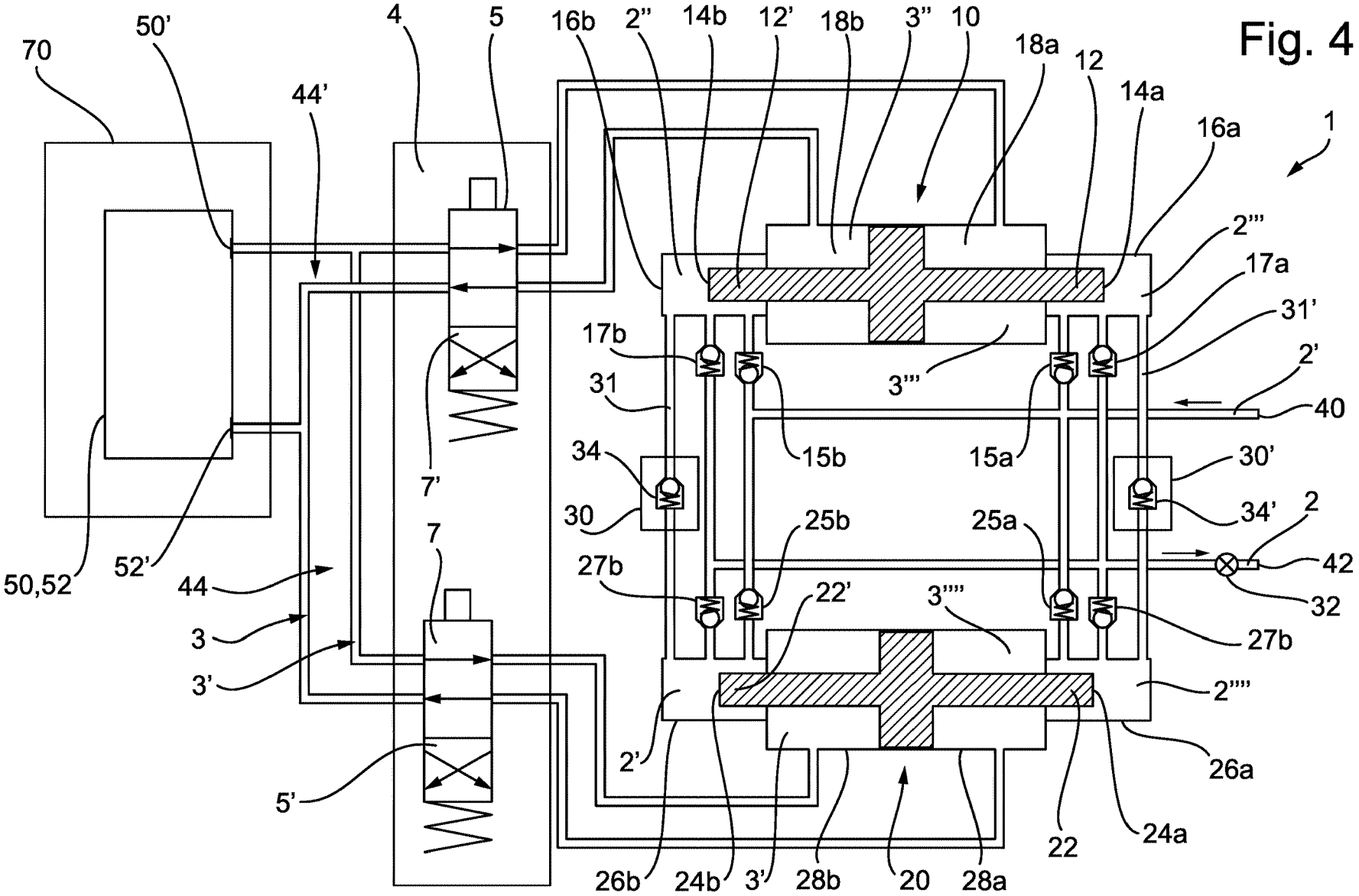
FIG. 4 shows a general pump schematic of the multipiston pump module according to FIG. 1.

The multipiston pump module 1 can be connected to hydraulic pressure means 50 and fluid reservoir means 52 as shown with FIG. 4. These hydraulic pressure means and fluid reservoir means can for example be provided by a ROV 70. The connection can be established via a drive fluid manifold 44 directing a drive fluid 3 to the multipiston pump module 1 and its individual pistons 10, 20.

As can be seen with FIGS. 2 to 4 the first and second pistons 10, 20 are preferably each having two piston heads 14 *a, b*; 24 *a, b* oscillating forth and back in a respective piston chamber 16 *a, b*; 26 *a, b* under the control of the control means 4 for pumping the media fluid 2. Thereby each piston head 14 *a, b*; 24 *a, b* and/or each piston chamber 16 *a, b*; 26 *a, b* of the first and second piston 10, 20 can comprise at least two check valves 15 *a, b*; 25 *a, b*; 17 *a, b*; 27 *a, b*, at least one 15 *a, b*; 25 *a, b* each for suction of the media fluid 2 through a suction manifold 40 to the pistons 10, 20 and at least one 17 *a, b*; 27 *a, b* each for discharge of the media fluid 2 through a discharge manifold 42 out of the pistons 10, 20.

The pistons shown here 10, 20 are hydraulic pistons, driven by the drive fluid 3 in an oscillating manner, which is directed under pressure to hydraulic piston chambers 18 *a, b*; 28 *a, b* of the first and the second pistons 10,20 and, as mentioned, e.g. is provided by a ROV via the drive fluid manifold 44.

For controlling the oscillations the control means 4 is arranged in such a way that it directs the drive fluid 3 to the pistons 10, 20 in a timed manner. In detail, the control means 4 is arranged that it can control the oscillation phase of the pistons 10, 20 preferably individually, as will be explained in the following.

Preferably, the control means 4 is arranged to switch the fluid flow of the driving fluid 3 between the two hydraulic piston chambers 18 *a, b*, 28 *a, b* of each piston 10, 20 thereby controlling the oscillation of each piston 12, 22.

The control means 4 are preferably remotely controllable and especially electronically controllable. In more detail, they preferably comprise at least one electronically controllable valve 5 and especially at least one solenoid and/or servo valve 5 provided in the drive fluid manifold 44 for controlling at least one piston 10, 20. The valves 5 are independently controlled comprising a control piston 7 each, which oscillates back and forth in a timed manner to direct the drive fluid 3 either to the one piston head 14 *a*, 24 *a* or to the other piston head 24 *b*, 24 *b* of the respective pump.

With this embodiment two identical pistons 10, 20 are provided. Each one has a central hydraulic section that drives the pistons 10, 20 using hydraulic oil or a similar hydraulic fluid as a drive fluid 3 directed in a timed oscillating manner from the control means 4 and its respective valves 5. Each piston 10, 20 has two (media fluid) pump heads 12, 22 (piston heads 14, 24 plus piston chambers 16, 26) that pump the media fluids 2, for example water, sea water or glycol or combinations thereof from a source to a target.

Therefore, each piston 10, 20 oscillates back and forth under the control of its valve 5 of the control means 4. With this embodiment, each pump has its own valve 5, all of them being controllable. It is also possible that only one valve 5 is controllable so that the phase of one pump is changeable relative to the phase of the other pump. It is also possible to provide the valves 5 and the control means 4 as an external means so that multiple pistons and/or pistons are controlled by one valve 5 or control means respectively.

The pumping operation functions as follows: as the pistons 10, 20 stroke left, media fluid 2 is sucked into the respective right hand piston chambers 16 *a*, 26 *a* and pushed out of the left hand piston head 16 *b*, 26 *b*. As the piston 10, 20 strokes to the right, media fluid is sucked into the left hand piston chamber 16 *b*, 26 *b* and pushed out of the right one 16 *a*, 26 *a*, thus pumping media fluid from the suction manifold 40 to the discharge manifold 42.

As can be seen with FIGS. 2 and 4, the multipiston pump module 1 further comprises the piston connection means, fluidly connecting the two pistons 10, 20 in a controllable manner, so that in parallel mode p the pistons 10, 20 are pumping the media fluid in parallel, resulting in a high media fluid flow and low media fluid pressure, and in serial mode s, they are pumping the media fluid in serial, resulting in a low media fluid flow and a high media fluid pressure. Preferably the piston connection means 31 is having a cross feeding valve means 30 having a valve 34. The valve 34 is preferably provided as a check valve 34 for establishing and closing the fluid connection between the piston chamber 16 *a* and 16 *b* respectively of the first piston 10 and a respective another piston chamber 26 *a* and 26 *b* respectively of the second piston 20. With this embodiment at least two valves 34 are provide in such a way that both piston chambers 16 *a*, 16 *b* of the first piston are controllable connected with the respective other piston chambers 26 *a*, 26 *b* of the second piston 20.

The cross feeding valve means 30 and especially the valve 34 is preferably arranged in such a way that in the serial mode s an output of a near side piston head 14 *a*; 14 *b* of the first piston 10 is directed to an input of a far side piston head 24 *a*; 24 *b* of the second piston 20, so that the media fluid pressure outputted from the first piston 10 is additive to the drive fluid 3 pressure of the second piston 20 or vice versa. Versa means that of course this addition is also possible arranged in an opposite way, namely in a fluid flow from the second piston to the first piston.

In a special embodiment, the cross feeding valve means 30 comprises a check valve 34 having a defined opening pressure threshold.

As has been explained, the cross feeding valve means and its respective valves 34 connect the pistons 10, 20 to allow media fluid 2 to be feed from the piston chambers 16 *a, b* to the piston chambers 26 *a, b*. This allows the pistons 10, 20 to work in either serial (high pressure) mode or parallel (high flow) mode. Of course, it has to be mentioned that in parallel mode the cross feeding valve means 30 are arranged and especially closed in such a way that they are blocking the cross feeding connection 31 between the two pistons 10, 20. It further has to be mentioned that the valve means 30 and preferably the valves 34 preferably open and close intrinsically, dependent on the parallel or serial mode respectively activated by the control means 4. The detailed pump schematic will be explained in the following.

A sensor means 32 can be provided, especially on the output side, e.g. in the discharge output manifold 42, adapted to provide pressure information to a control arrangement and especially to the control means 4. The module 1 can be arranged in such a way, that when a defined pressure threshold is detected by the sensor means 32 the control means 4 automatically changes the operation mode from parallel to serial mode, or vice versa.

Preferably the control means changes the operation mode when the detected pressure level is basically preferably 10% below, more preferably 5% below, and most preferably at the maximum pressure level one of the two pistons 10, 20 can produce on their output side.

With regard to the claimed method of pumping a media fluid, the following FIGS. 5 to 8 describe the method steps of pumping a media fluid under subsea conditions from a source to a target, wherein the method comprises the steps of pumping the media fluid via a multipiston pump module 1 comprising at least a first and a second reciprocating piston 10, 20, oscillatingly arranged to pump a media fluid 2 from a source to a target. During piston operation, the first and second pistons 10, 20 are controlled by a control means 4 in such a way that the first and second pistons 10, 20 are at least either driven in parallel mode p, where the pistons 10, 20 are driven in phase with each other or in a serial mode s where the pistons 10, 20 are driven out of phase with each other, and especially out of phase by half a cycle. The pistons 10, 20 are further are connected with each other by at least one piston connection means 31 in a controllable manner, so that in parallel mode p the pistons are pumping the media fluid in parallel, resulting in a high media fluid flow and low media fluid pressure, and in serial mode s, they are pumping the media fluid in serial, resulting in a low media fluid flow and a high media fluid pressure.

Figure 9:
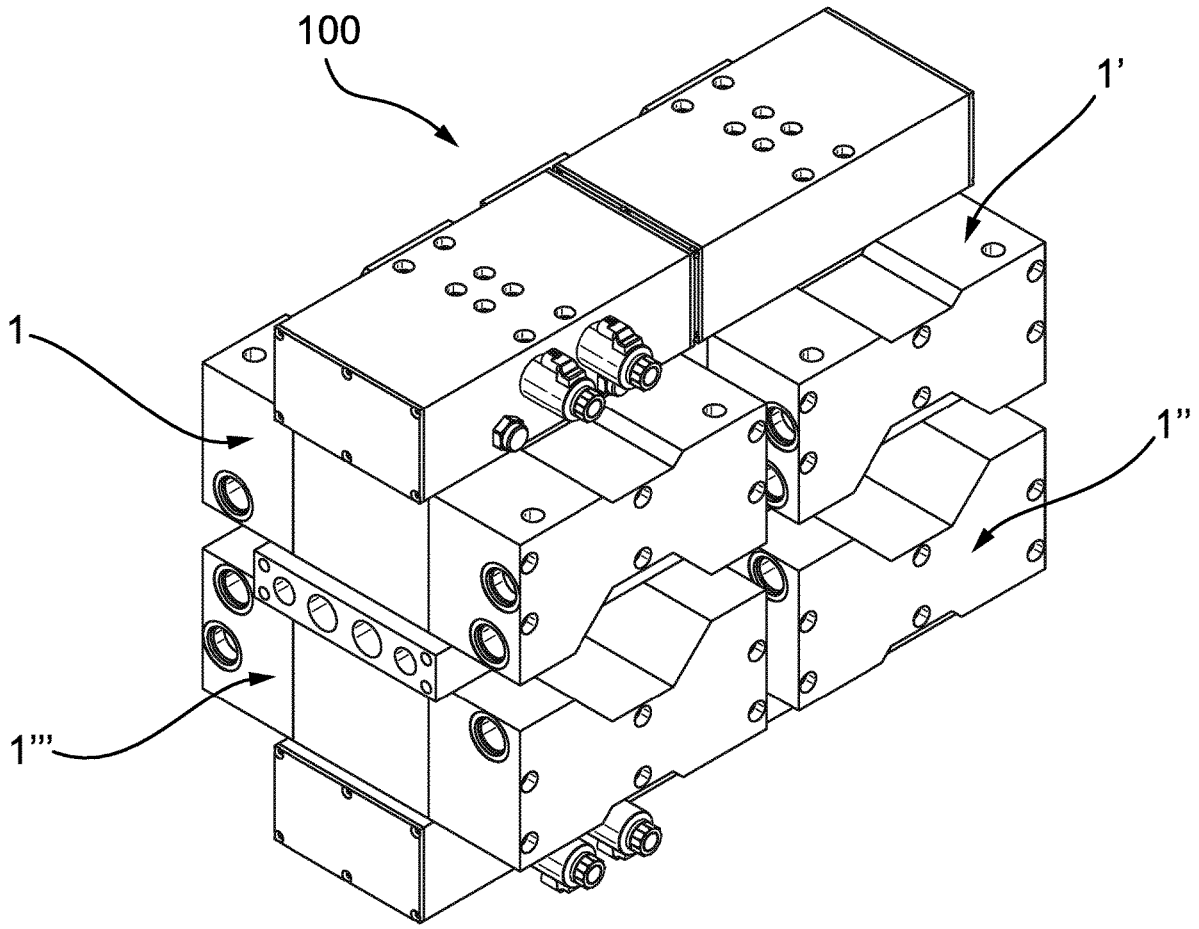
FIG. 9 shows a perspective view of a first embodiment of a subsea multistage pump.
Figure 10:
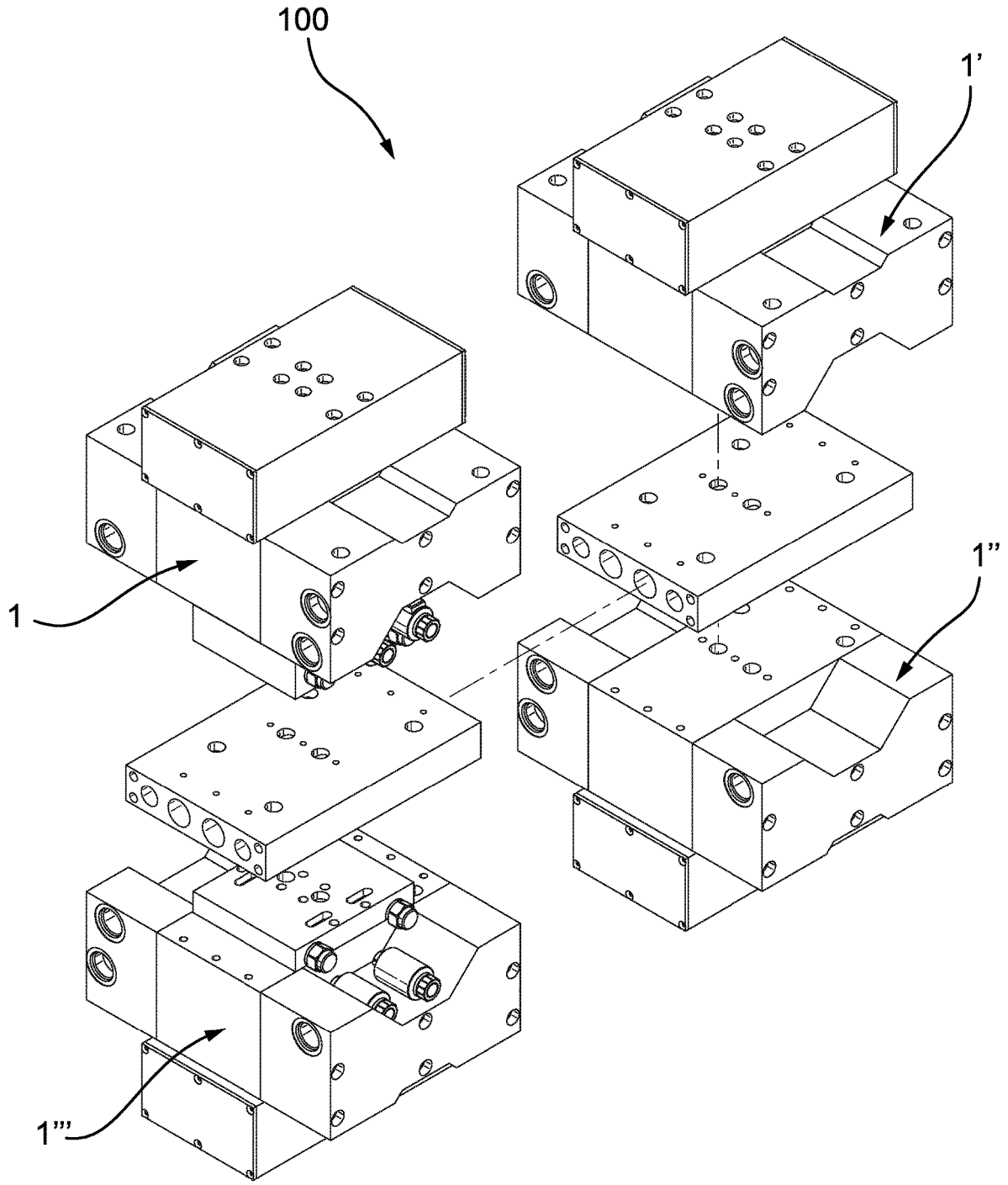
FIG. 10 shows an exploded perspective view the embodiment according to FIG. 10.
Figure 11:
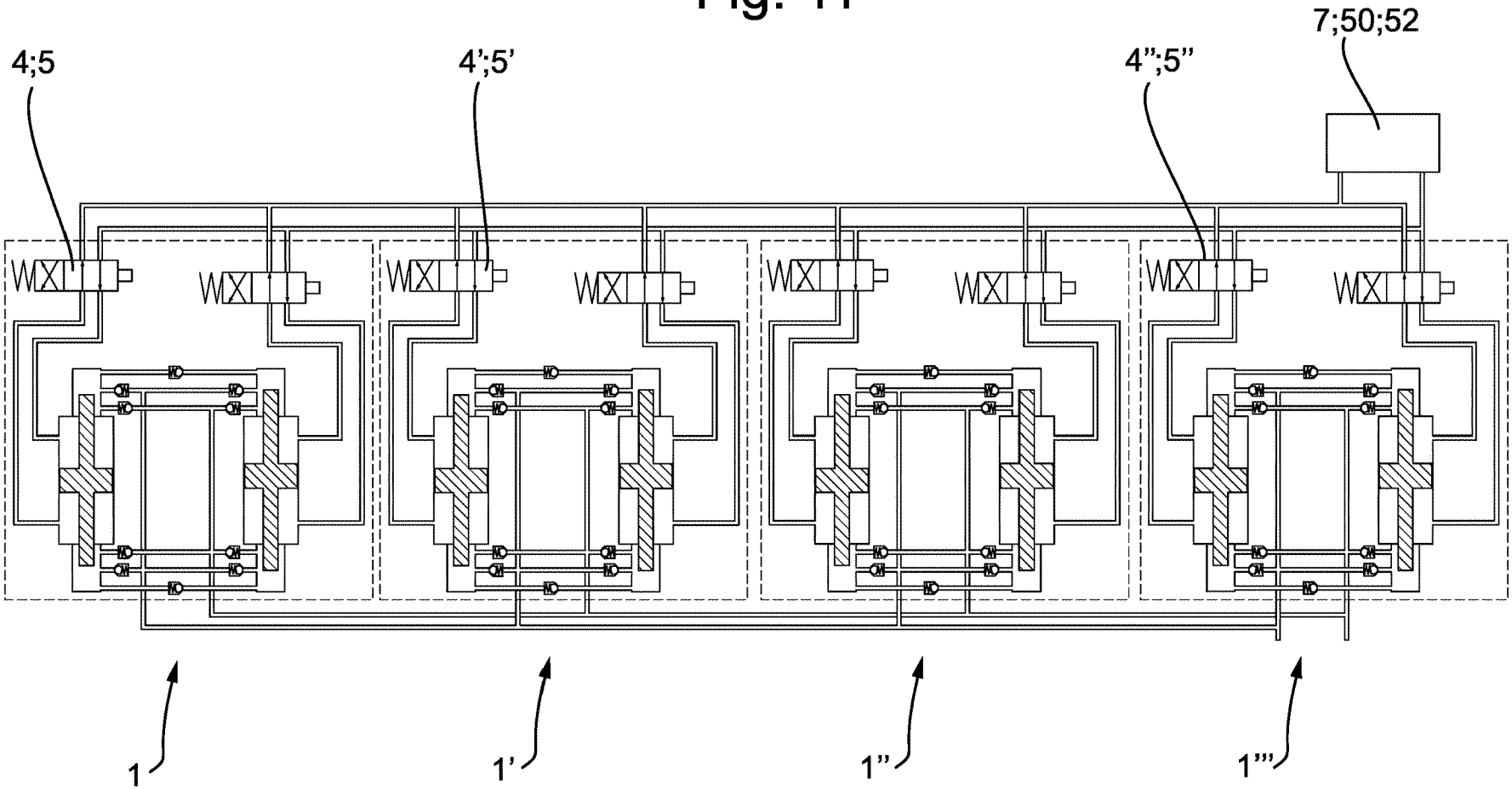
FIG. 11 shows a general pump schematic of the embodiment of FIG. 9.

As mentioned, the multipiston pump modules 1 can be arranged especially in parallel with each other to provide a multistage pump 100 as shown with FIGS. 9-11. The result is a multistage pump 100 having a higher flow rate as the individual single multipiston pump modules 1 basically providing the same pressure. Each multipiston pump module 1 is adaptable via control means 4, wherein as shown with FIG. 11 each multipiston pump module 1 has its own valve 5 as part of the control means 4. Each multipiston pump module 1, e.g. as shown with FIGS. 9-11, can be self-contained and may include all valves necessary for operation.

FIGS. 5 to 8 are in detail showing different schematic views showing the operation of a multipiston pump module 1 in low pressure and high pressure mode. Different pressures of the drive fluid 3 and the media fluid 2 are represented by different patterns and reference signs 60-68, respectively.

As mentioned, the inventive multipiston pump module 1 and especially the embodiment shown here is arranged to act in at least two different operating modes, namely a parallel operating mode p and a serial operating mode s. The parallel operating mode is shown in the FIGS. 5 and 6. This parallel operating mode is the low pressure mode p, where both pistons 10, 20 of the multipiston pump module 1 are oscillating in phase relative to each other; that means that if the one piston 10 oscillates to the right side (see FIGS. 5 and 6) also the second piston 20 oscillates to the right side.

Due to the arrangement of the piston connection means, and especially of a valve means 30 having a valve 34 in combination with the in phase oscillation of the two pistons 10, 20, there is no cross fluid flow of the media fluid 2. The valve 34 preferably is a check valve 34. The movement of the pistons 10, 20 is synchronized by hydraulic or electronic controllers, namely the control means 4 and its valves 5.

By activating the control pistons 7, the fluid flow of the drive fluid 3 can be controlled as shown by the arrows A depicted in the control pistons 7. As soon as the control cylinder 7 oscillates forth and back, the drive fluid 3 is directed in an oscillating way to the pistons 12, 20, actuating them in an oscillating manner.

The drive fluid 3 is fed by hydraulic pressure means 50 and fluid reservoir means 52 which can be arranged at a ROV or Skid 70 respectively.

Figure 5:
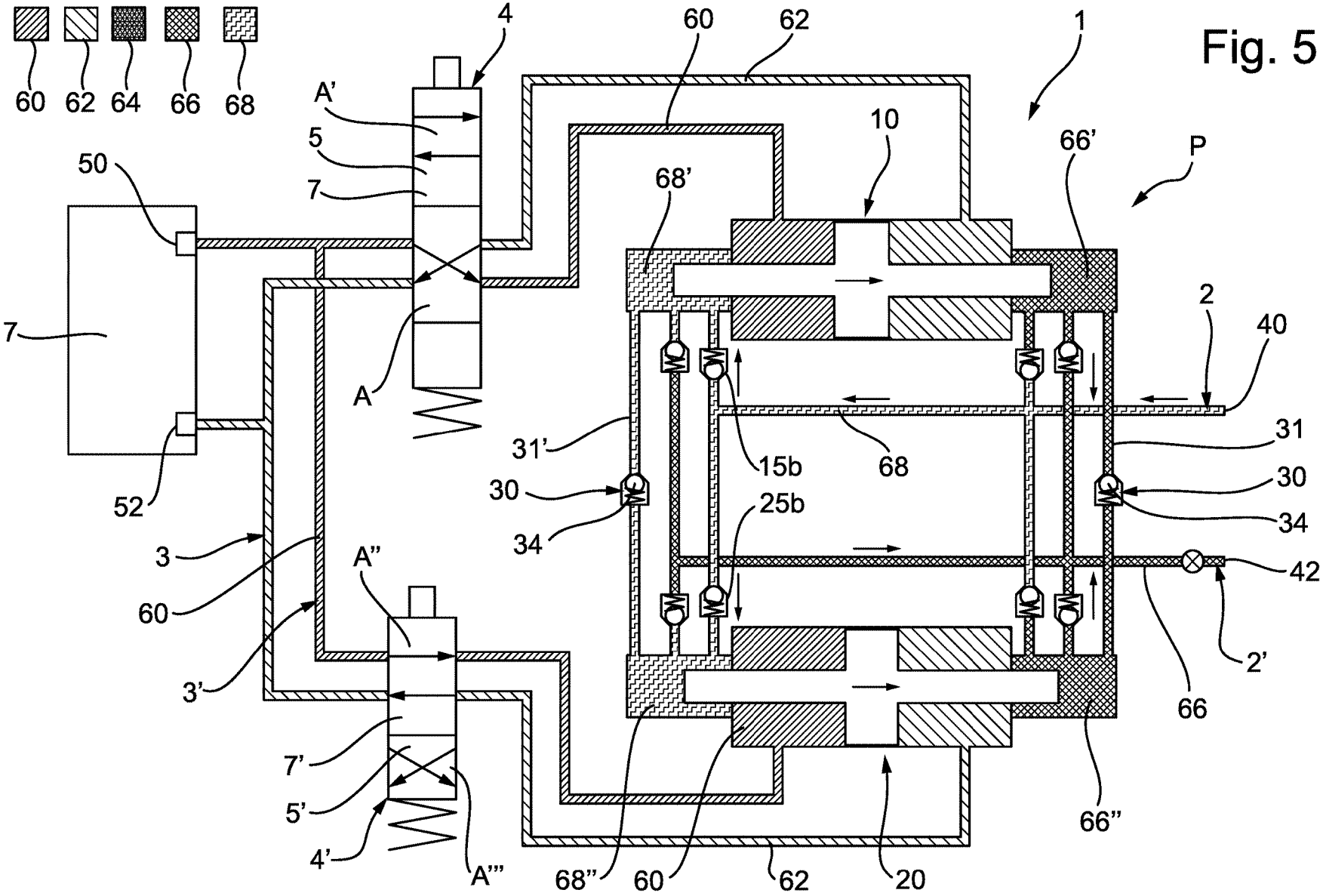
FIG. 5 shows a pumping schematic with pistons stroking right in parallel low pressure mode.

With FIG. 5 also the pressure situation is shown, and in detail a pressure situation when the two pistons 10, 20 are stroking to the right in phase.

Reference sign 60 shows a high pressure drive fluid 3 provided from the hydraulic pressure means 50, oscillating the first piston 10 and the second piston 20 to the right side. The pressure is preferably around 190 to 210 bar.

Reference sign 62 shows the low pressure drive fluid 3 coming from the pistons 10 and 20 back to the fluid reservoir means 52. The pressure preferably is around 1 to 5 bar above ambient pressure.

Reference sign 68 shows the low pressure media fluid on the suction side and in detail in the suction manifold 40 side. This pressure is around ambient pressure. Once it has passed through the check valves 15 *b*, 25 *b*, it may be down to around 0.6 bar below ambient pressure.

Reference sign 66 represents the medium media fluid pressure which is up to 180 bar, wherein this pressure is being dependent on the back pressure in the discharge manifold 42. That means the higher the back pressure in the discharge manifold 42 is, the higher the medium drive fluid pressure 66 is.

Figure 7:
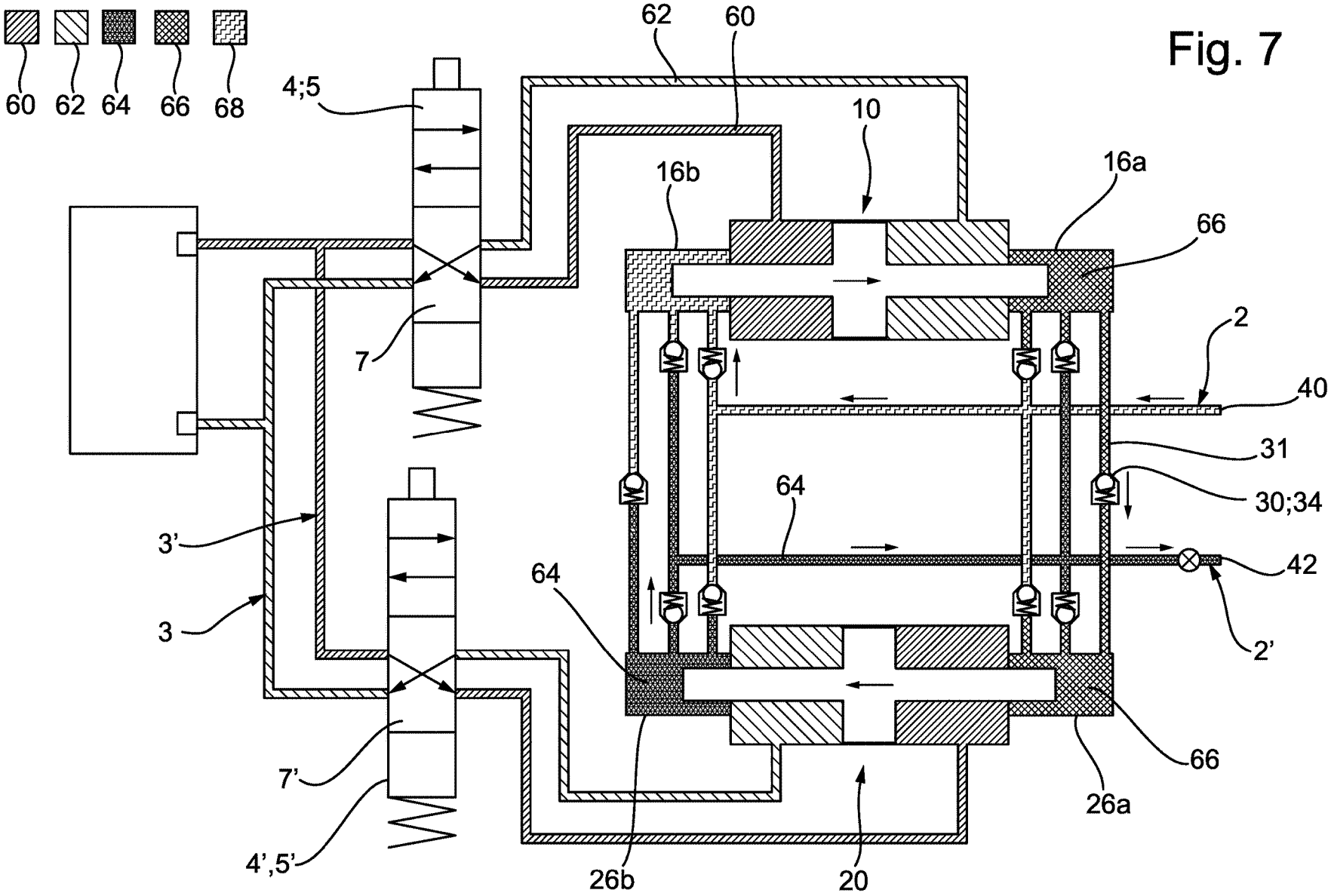
FIG. 7 shows a pumping schematic with pistons stroking right in serial high pressure mode.
Figure 8:
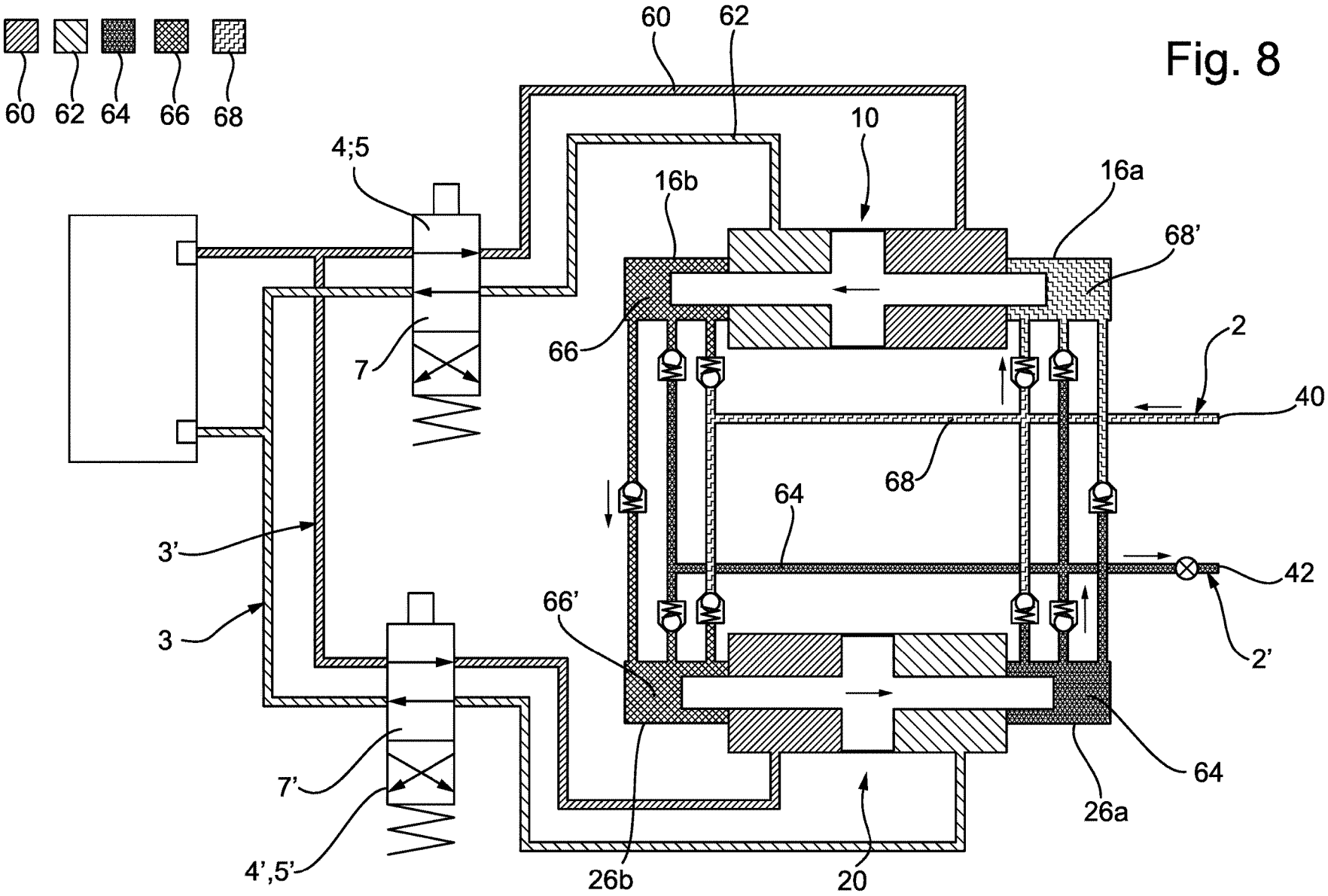
FIG. 8 shows a pumping schematic with pistons stroking left in serial high pressure mode.

Reference sign 64 is only relevant in the high pressure serial mode of the multipiston pump module 1 as shown with FIGS. 7 and 8. This pressure is up to 345 bar and is also dependent on the back pressure at the discharge manifold 42.

Figure 6:
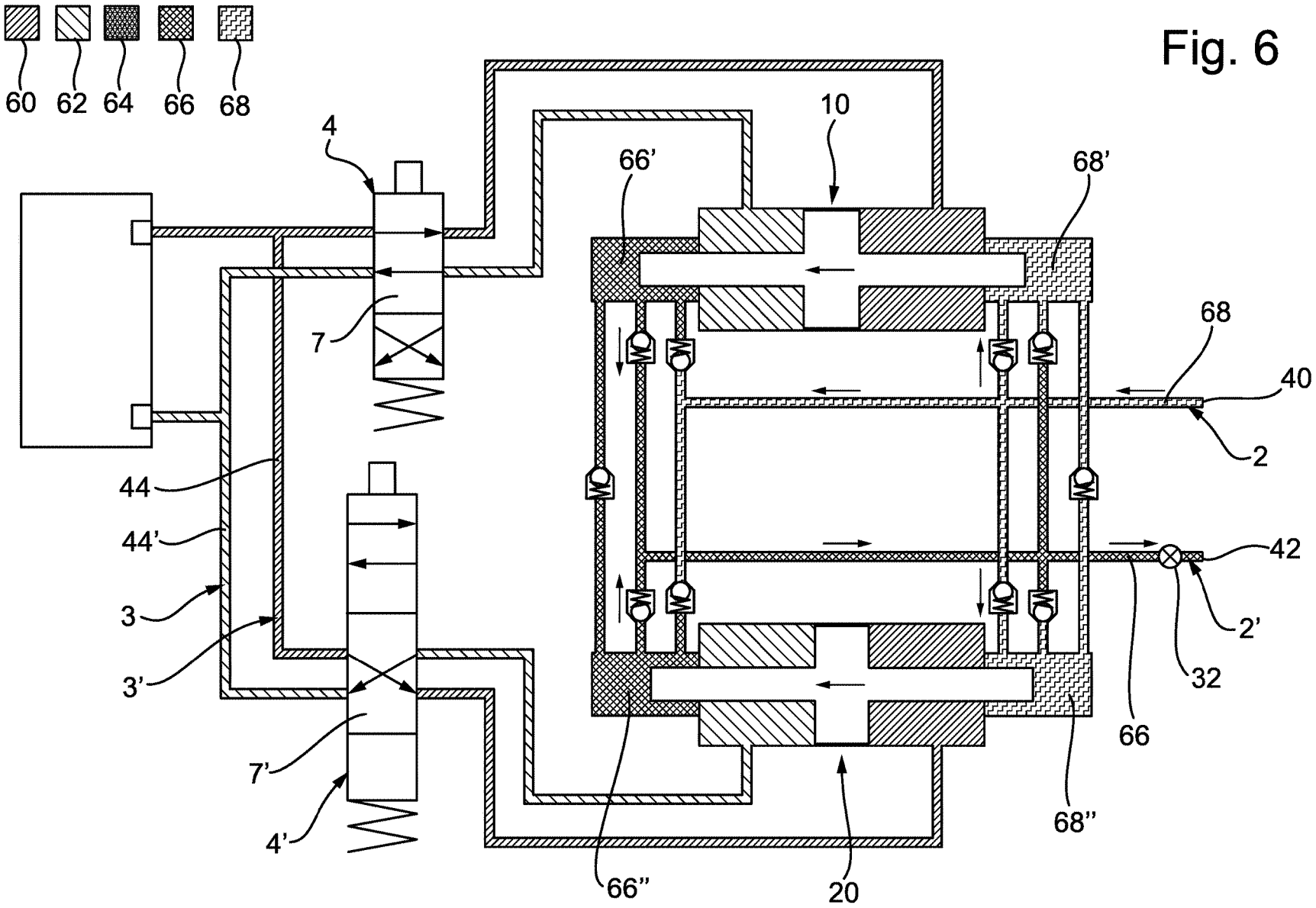
FIG. 6 shows a pumping schematic with pistons stroking left in parallel low pressure mode.

The situation shown in FIG. 6 is almost identical to the one described before, however in a vice versa orientation, as due to a different oscillation position of the control piston 7 of the control means 4, the drive fluid 3 is now directed vice versa, oscillating the pistons 10, 20 to the opposite, left side. The pressure situation established in the drive fluid manifold 44 is therefore also established vice versa, wherein the pressure situation in the end portions of the suction manifold 40 and the discharge manifold 42 are the same.

If additional discharge pressure is needed for discharging the media fluid 2 against the back pressure at the discharge manifold 42, the control means 4 senses this, preferably using a pressure sensor means 32 and then changes the operation of the first piston 10 and the second piston 20 from parallel mode to serial mode. The sensor means 32 can, for example, be arranged in the discharge manifold 42.

This serial mode operation providing high pressure at the discharge manifold 42 are shown with FIGS. 7 and 8. The module 1 provided is the same as the one explained before.

Under serial operation the two pistons 10, 20 are oscillating out of phase with each other and especially out of phase by half a cycle. When the first piston 10 strokes right, media fluid 2 is sucked via the suction manifold 40 into the left side of the first piston 10 and its respective piston chamber 16 *b*. Accordingly, media fluid 2 is then driven out of the right side of the first piston 10 and the respective piston chamber 16 *a*. Since the discharge pressure (at the discharge manifold 42) is greater than the pressure that the first piston 10 can generate, the media fluid 2 flows through the right hand cross feeding valve means 30 and its respective valve 34 and the piston connection means 31 into the right side of the second piston 20 and its respective piston chamber 26 *a*. The media fluid pressure is a medium media fluid pressure 66 in this area.

The media fluid 2 being pushed into the right side of the second piston 20 and its respective piston chamber 26 *a* tries to push the piston 20 to the left. This force plus the force of the drive fluid 3 of the second piston 20 pushes the second piston 20 to the left with around double force (media fluid force plus hydraulic force), which pushes the media fluid 2 out of the left side of the second piston 20 and its respective piston chamber 26 *b* into the discharge manifold 42. The pressure established is high pressure 64.

Once both pistons 10, 20 have stroked, the pistons then reverse direction and the left hand cross feed valve means 30 and its respective valve 34 comes into play.

This operation scheme is shown in FIG. 8 wherein the before mentioned can be applied.

In the serial mode, the multipiston pump module 1 can discharge media fluid 3 at around double pressure but around half the flow. For a special embodiment, the disclosed multipiston pump module 1 comprises pistons each having a single operation point that characterizes the pump. A preferred operation point of one piston is around 200 lpm at 350 bar. Given a constant hydraulic flow, combining two of these pistons in series can double the pressure whilst halving the flow. Placing two pistons in parallel can double the flow while halving the pressure. By connecting the pistons via the piston connection means and controlling the pump operation via the control means, a multipiston pump module is built having two possible operation points, one with the pump running in series, one with running in parallel. It is suggested building a pump that is capable of either 400 bar at 190 lpm, or 220 bar at 380 lpm. It can be seen that the pressures and flows are not exactly double due to the additional losses that are incurred by the valving needed to permit the two operation modes.

In the foregoing specification, the invention has been described with reference to a specific embodiment of the invention. It will, however, be evident that various modifications and changes may be made therein without departing from the broader spirit and scope of the invention as set forth in the appended claims. It has to be mentioned that all the features mentioned and especially the features mentioned in the claims could be provided with an embodiment of the invention in combination or on their own. The combination of features as brought forward with the above embodiments is not necessarily required.

However, other modifications, variations and alternatives are also possible. The specifications, drawings and examples are, accordingly, to be regarded in an illustrative rather than in a restrictive sense.

In the claims, any reference signs placed between parentheses shall not be construed as limiting the claim. The word 'comprising' does not exclude the presence of other features or steps then those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to advantage.

REFERENCE SIGNS

1 Subsea multipiston pump module
2 Media fluid
2 Drive fluid
4 Control means
5 Valve
6 Housing
7 Control piston
8 Manifold plate
10 First reciprocating piston
12 Pump head
14 *a, b* Piston head
15 *a, b* Check valves
16 *a, b* Piston chambers
17 *a, b* Check valves
18 *a, b* Hydraulic piston chamber
20 Second reciprocating piston
22 Pump head
24 *a, b* Piston head
23
25 *a, b* Check valve
26 *a, b* Piston chamber
28 *a, b* Hydraulic piston chamber
27 *a, b* Check valve
30 Cross feeding valve means
31 Piston connection means
32 Sensor means
34 Valve
40 Section manifold
42 Discharge manifold
44 Drive fluid manifold
50 Hydraulic pressure means
52 Fluid reservoir means
60 High pressure drive fluid
62 Low pressure drive fluid
64 High pressure media fluid
66 Medium pressure media fluid
68 Low pressure media fluid
70 ROV/Skid
100 Subsea multistage pump
A Arrow

The invention claimed is:

1. A subsea multipiston pump for closing a hydraulic ram of a blowout preventer, comprising:

at least a first and a second piston, oscillatingly arranged to pump a media fluid from a source to a target, the first and the second pistons being driven either in a parallel mode oscillating in phase with each other, or in a serial mode oscillating out of phase with each other; and at least one piston connection device for fluidly connecting the two pistons in a controllable manner, so that in parallel mode the first and the second pistons are pumping the media fluid in parallel, and in serial mode, the first and the second pistons are pumping the media fluid in serial.

2. The subsea multipiston pump according to claim 1, wherein the first and the second pistons are arranged within a common housing.

3. The subsea multipiston pump according to claim 1, wherein the first and the second pistons comprise at least two piston heads oscillating forth and back in respective piston chambers for pumping the media fluid.

4. The subsea multipiston pump according to claim 1, wherein the first and the second pistons are fluidly connected with a suction manifold for suction of the media fluid and with a discharged manifold for discharge of the media fluid.

5. The subsea multipiston pump according to claim 4, wherein the suction manifold of the first and the second pistons comprises at least one check valve and/or the discharge manifold of the first and the second pistons comprises at least one check valve.

6. The subsea multipiston pump according to claim 1, wherein the first and the second pistons are hydraulic pistons driven by a drive fluid supplied from a remotely operated vehicle.

7. The subsea multipiston pump according to claim 1, wherein a controller directs a drive fluid to the first and the second pistons in a time controlled manner for oscillating the first and the second pistons for individually controlling the phase of the first and the second.

8. The subsea multipiston pump according to claim 1, wherein a controller is arranged to switch the fluid flow of the driving fluid between at least two hydraulic piston chambers of at least one piston of the first or the second pistons, for changing the oscillation phase of the respective piston dependent on the fluid pressure of the media fluid.

9. The subsea multipiston pump according to claim 1, wherein a controller for driving the first and the second pistons is remotely controllable and electronically controllable.

10. The subsea multipiston pump according to claim 1, wherein a controller comprises at least one electronically controllable valve and at least one solenoid and/or servo valve provided in a drive fluid manifold of the first and the second pistons.

11. The subsea multipiston pump according to claim 1, wherein a controller comprises a sensor for detecting a pressure level of the media fluid.

12. The subsea multipiston pump according to claim 11, wherein the sensor is arranged on an output side and in a discharge manifold of the first and the second pistons.

13. The subsea multipiston pump according to claim 1, wherein, a controller is arranged to automatically change from parallel mode to serial mode and/or vice versa, when a defined pressure threshold in the media fluid and in a discharge manifold of the first and the second pistons is detected.

14. The subsea multipiston pump according to claim 1, wherein, the piston connection device comprises a cross feeding valve.

15. The subsea multipiston pump according to claim 14, wherein the cross feeding valve comprises at least one valve and a check valve.

16. The subsea multipiston pump according to claim 15, wherein, the at least one valve and the check valve are arranged to establishes a fluid connection between the first and the second piston.

17. The subsea multipiston pump according to claim 14, wherein the cross feeding valve comprises at least one valve arranged within the piston connection device and in at least one fluid connection between a piston chamber of the first piston and a piston chamber of the second piston.

18. The subsea multipiston pump according to claim 14, wherein the cross feeding valve comprises at least one valve arranged that in the serial mode an output of a near side piston head of the first piston is directed to an input of a far side piston head of the second piston, so that a media fluid pressure outputted from the first piston is an additive to a drive fluid pressure of the second piston or vice versa.

19. The subsea multipiston pump according to claim 14, wherein the cross feeding valve is remotely and electronically controllable.

20. The subsea multipiston pump according to claim 1, further comprising an additional subsea multipiston pump comprising a third and a fourth piston and the additional multipiston pump being fluidly connected with the subsea multipiston pump.

21. The subsea multipiston pump according to claim 20, wherein the additional subsea multipiston pump is fluidly connected with the subsea multipiston pump in parallel.

22. An intervention skid for attachment to a remotely operated vehicle, the intervention skid comprising:

at least one multipiston pump comprising:

at least a first and a second piston, oscillatingly arranged to pump a media fluid from a source to a target, the first and the second pistons being driven either in a parallel mode, where they are oscillating in phase with each other, or in a serial mode, where they are oscillating out of phase with each other; and at least one piston connection device for fluidly connecting the two pistons in a controllable manner, so that in parallel mode the first and the second pistons are pumping the media fluid in parallel, and in serial mode, the first and the second piston are pumping the media fluid in serial.

23. A method of pumping a media fluid under subsea conditions from a source to a target, the method comprising:

pumping the media fluid via a multipiston pump, the multipiston pump comprising at least a first and a second reciprocating piston, oscillatingly arranged to pump a media fluid from a source to a target; and controlling first and the second pistons being either driven in a parallel mode in phase with each other, or in a serial mode out of phase with each other wherein the first and the second pistons are connected with each other by at least one piston connection device so that in the parallel mode the first and the second pistons are pumping the media fluid in parallel, and in the serial mode, the first and the second pistons are pumping the media fluid in serial.

24. The subsea multipiston pump according to claim 1, wherein the serial mode oscillating out of phase between the first piston and second piston is by half a cycle.

* * * * *